US008337233B2

(12) United States Patent
Wu

(10) Patent No.: US 8,337,233 B2
(45) Date of Patent: Dec. 25, 2012

(54) ELECTRICAL CONNECTOR ASSEMBLY WTH LATCH MECHANISM EASILY OPERATED

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/156,367

(22) Filed: Jun. 9, 2011

(65) Prior Publication Data

US 2011/0306228 A1 Dec. 15, 2011

(30) Foreign Application Priority Data

Jun. 10, 2010 (CN) ..... 2010 1 0197726

(51) Int. Cl.
*H01R 4/50* (2006.01)

(52) U.S. Cl. ..... 439/345

(58) Field of Classification Search ..... 439/345, 439/350–358

See application file for complete search history.

(56) References Cited

U.S. PATENT DOCUMENTS

| | | | | |
|---|---|---|---|---|
| 6,786,742 | B2 * | 9/2004 | Matsuoka | 439/95 |
| 7,281,937 | B2 | 10/2007 | Reed et al. | |
| 7,318,740 | B1 * | 1/2008 | Henry et al. | 439/352 |
| 7,354,292 | B1 * | 4/2008 | Lloyd et al. | 439/352 |
| 7,581,978 | B1 | 9/2009 | Briant | |
| 7,938,669 | B2 | 5/2011 | Li et al. | |
| 8,062,049 | B2 | 11/2011 | Tobey | |
| 2002/0111060 | A1 * | 8/2002 | Challis et al. | 439/352 |
| 2004/0002263 | A1 | 1/2004 | Matsuoka | |
| 2006/0148300 | A1 * | 7/2006 | Huang et al. | 439/353 |
| 2011/0300735 | A1 | 12/2011 | Wu | |

FOREIGN PATENT DOCUMENTS

| | | |
|---|---|---|
| CN | 201097418 Y | 8/2008 |
| CN | 201829715 U | 5/2011 |

* cited by examiner

*Primary Examiner* — Jean F Duverne
(74) *Attorney, Agent, or Firm* — Wei Te Chung; Ming Chieh Chang

(57) ABSTRACT

An electrical connector assembly (100), comprises: a housing (1) having therein at least three receiving rooms (11) extending along a front-to-rear direction and communicating with an exterior; two printed circuit boards (2) received into each of receiving room and positioned in the housing; a strain relief (5) disposed in the housing; a latch mechanism assembled to an exterior surface of the housing; and engaging means (9) assembled to the housing along a vertical direction to interlock the strain relief to the housing.

8 Claims, 25 Drawing Sheets

ELECTRICAL CONNECTOR ASSEMBLY WTH LATCH MECHANISM EASILY OPERATED

FIELD OF THE INVENTION

The present invention generally relates to connectors suitable for transmitting data, more specifically to input/output (I/O) connectors with high-density configuration and high data transmitting rate.

DESCRIPTION OF PRIOR ART

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire at increasing performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

Additionally, there is a desire to increase the density of I/O plug-style connectors and this is difficult to do without increasing the width of the connectors. Increasing the width of the plug connectors leads to difficulty in fitting the plug into standard width routers and/or servers, and would require a user to purchase non-standard equipment to accommodate the wider plug converters. As with any connector, it is desirable to provide a reliable latching mechanism to latch the plug connector to an external housing to maintain the mated plug and receptacle connectors together modifying the size and/or configuration the connector housing may result in a poor support for a latching mechanism. Latching mechanisms need to be supported reliably on connector housings in order to effect multiple mating cycles. Accordingly, certain individuals would appreciate a higher density connector that does not have increased width dimensions and which has a reliable latching mechanism associated therewith.

And, I/O connector will has a developing trend to form multi-ports on a front end thereof to meet more and more higher data transmitting rate requirements of the server. As a result, a width of the electrical connector becomes larger. Thus, a latch formed on the electrical connector will be difficult to operate to achieve an engagement and disengagement between the I/O connector and the complementary connector.

As discussed above, an improved electrical connector overcoming the shortages of existing technology is needed.

SUMMARY OF THE INVENTION

Accordingly, an object of the present invention is to provide an electrical connector assembly with a latch mechanism easily operated.

In order to achieve the above-mentioned objects, an electrical connector assembly, comprises: a housing having therein at least three receiving rooms extending along a front-to-rear direction and communicating with an exterior; two printed circuit boards received into each of receiving room and positioned in the housing; a strain relief disposed in the housing; a latch mechanism assembled to an exterior surface of the housing; and engaging means assembled to the housing along a vertical direction to interlock the strain relief to the housing.

Other objects, features and advantages of the invention will be apparent from the following detailed description taken in connection with the accompanying drawings.

DETAILED DESCRIPTION OF PREFERRED EMBODIMENTS

Figure 1:
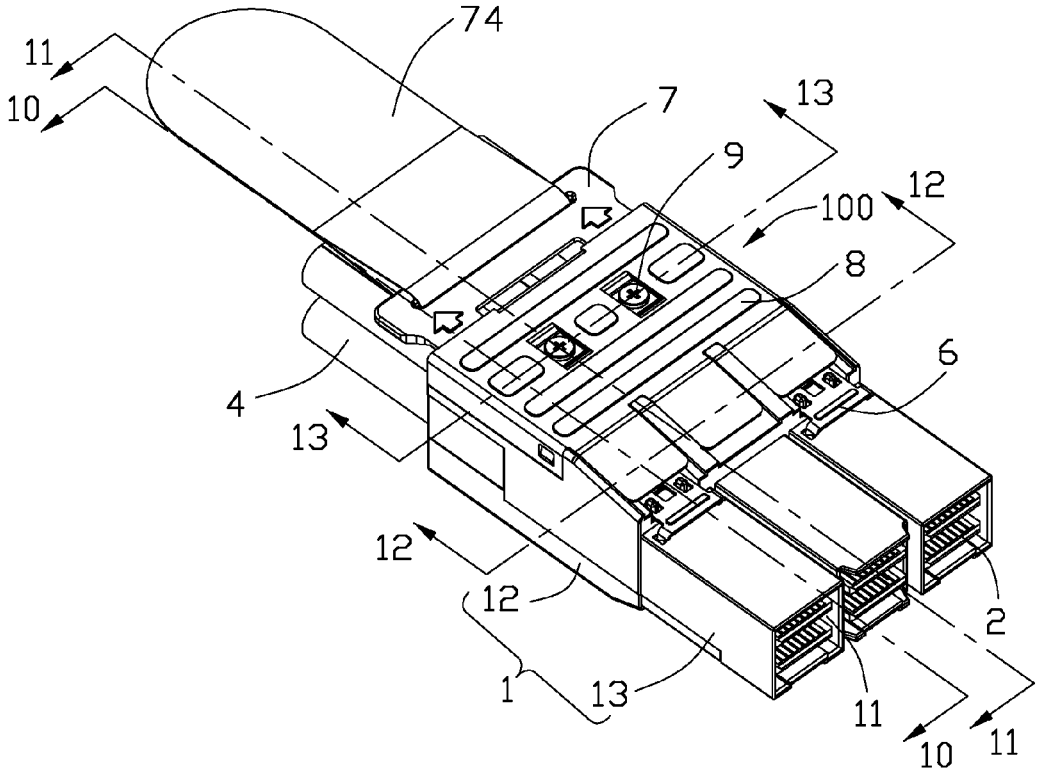
FIG. 1 is a perspective view of an electrical connector assembly in accordance with a first embodiment of the present invention.

Reference will now be made to the drawing figures to describe the present invention in detail.

Figure 2:
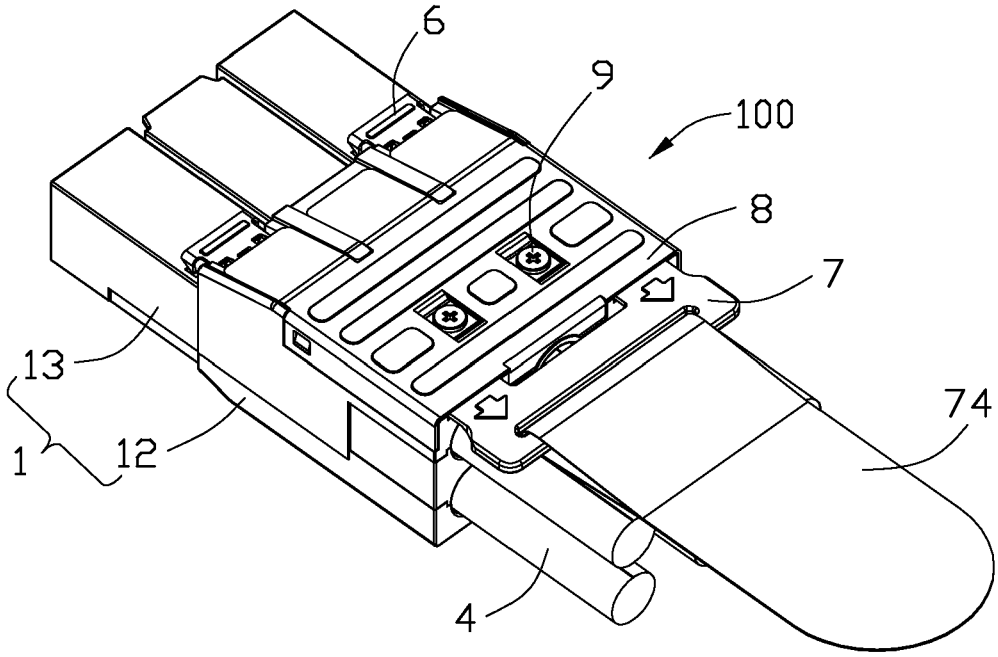
FIG. 2 is another perspective view of the electrical connector assembly of FIG. 1.
Figure 3:
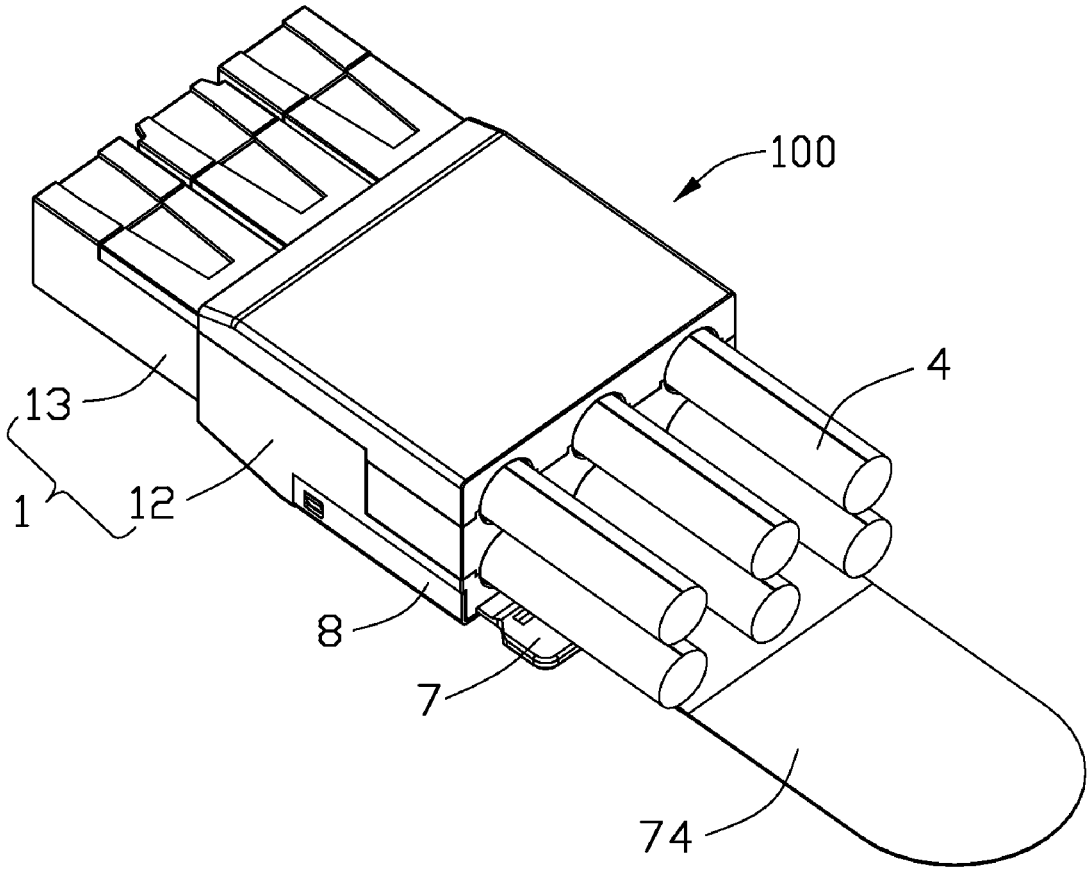
FIG. 3 is another perspective view of the electrical connector assembly of FIG. 2.

FIGS. 1 to 3 illustrate perspective views of an electrical connector assembly 100 made in accordance with a first embodiment of the present invention. And in conjunction with FIGS. 4 to 6 and 10 to 13, the electrical connector assembly 100 comprises a housing 1 having three receiving rooms 11 formed therein and spaced with each other, six printed circuit boards (PCBs) 2 received into the three receiving rooms 11, three spacers 3 respectively disposed in the three receiving rooms 11, six cables 4 respectively electrically connected with six printed circuit boards 2, a strain relief 5 disposed in the housing 1 and two engaging means 9 interconnecting the strain relief 5 to the housing 1. The electrical connector assembly 100 further comprises a latch mechanism assembled to a top surface of the housing 1 and a metallic shield 8 shielding a portion of the housing 1 and the latch mechanism. The latch mechanism comprises a pair of latching members 6 and a pulling member 7 interconnected with each other.

Referring to FIGS. 1 to 9, the housing 1 is made of metallic material and formed in a die-cast manner. The housing 1 defines a body portion 12 and a mating portion 13 extending forward from the body portion 12 for mating to a complementary connector (not shown). The body portion 12 has a cross section larger than that of mating portion 13. The mating portion 12 defines three mating ports. The housing 1 defines three receiving rooms 11 formed therein and respectively throughout the housing 1 along a front-to-rear direction. The three receiving rooms 11 are arranged side by side and spaced apart with each other. The body portion 12 of the housing 1 has a top surface defined as a first surface 121, the mating portion 13 of the housing 1 has a top surface defined as a second surface 131. The first surface 121 is disposed above the second surface 131. And, the first surface 121 defines an inclined surface toward to the second surface 131. The body portion 12 defines a pair of receiving cavities 14 extending downwardly from the inclined surface 1211 for a distance. The pair of receiving cavities 14 are spaced apart with each other along a transversal direction. A pair of supporting portions 141 are respectively formed on two inner side surfaces of each receiving cavity 14 for supporting a portion of the pulling member 7. Two spaced slits 142 are respectively formed in back of each receiving cavity 14 and communicated with the receiving cavity 14. The housing 1 has a pair of wedge-shaped projections 17 respectively formed on two side surfaces thereof for interlocking with the metallic shield 8.

Referring to FIGS. 4 to 9, the housing 1 comprises an upper shield part 15 and a lower shield part 16 assembled with each other. And, the upper shield part 15 defines three rectangular frames 151 formed on a front end thereof and spaced apart with each other. The upper shield part 15 defines a cutout 152 formed on a bottom side thereof and communicated with an exterior. A strain relief 5 is received into a rear end of the cutout 152. And, the cutout 152 of the upper shield part 15 is shielded by the lower shield part 16 along an up-to-down direction. In addition, the upper shield part 15 defines three passageways 153 communicated with an exterior through the cutout 152. Two semi-circular first positioning posts 154 are formed on an inner surface of each passageway 153 for supporting the printed circuit board 2. Another two semi-circular first positioning posts 154 are formed on another inner surface of each passageway 153 for supporting the printed circuit board 2. Each of two first positioning posts 154 are spaced apart with each other and arranged along a front-to-rear direction. And a second positioning post 155 is formed between two first positioning posts 154 for limiting a front-to-rear movement of the printed circuit board 2. It should be noted that two receiving cavities 14 of the housing 1 are formed on two sides of a top surface of the upper shield part 15. The upper shield part 15 defines two through holes 156. The lower shield part 16 defines two receiving holes 161 corresponding to the two through holes 156 along an up-to-down direction. The pair of wedge-shaped projections 17 are formed on two sides of the upper shield part 15. The upper shield part 15 defines three grooves 157 formed on a bottom surface thereof and arranged along a transversal direction. And two positioning projections 158 are respectively formed between two adjacent grooves 157. Two through holes 156 are located in front of the two positioning projections 158. The lower shield part 16 defines three grooves 162 formed on a top surface thereof and arranged along a transversal direction. And two positioning projections 163 are respectively formed between two adjacent grooves 162. Two receiving holes 161 are located in front of the two positioning projections 163. The positioning projections 158, 163 are used to achieve a cooperation between the strain relief 5 and the upper and lower shield part 15, 16.

Figure 6:
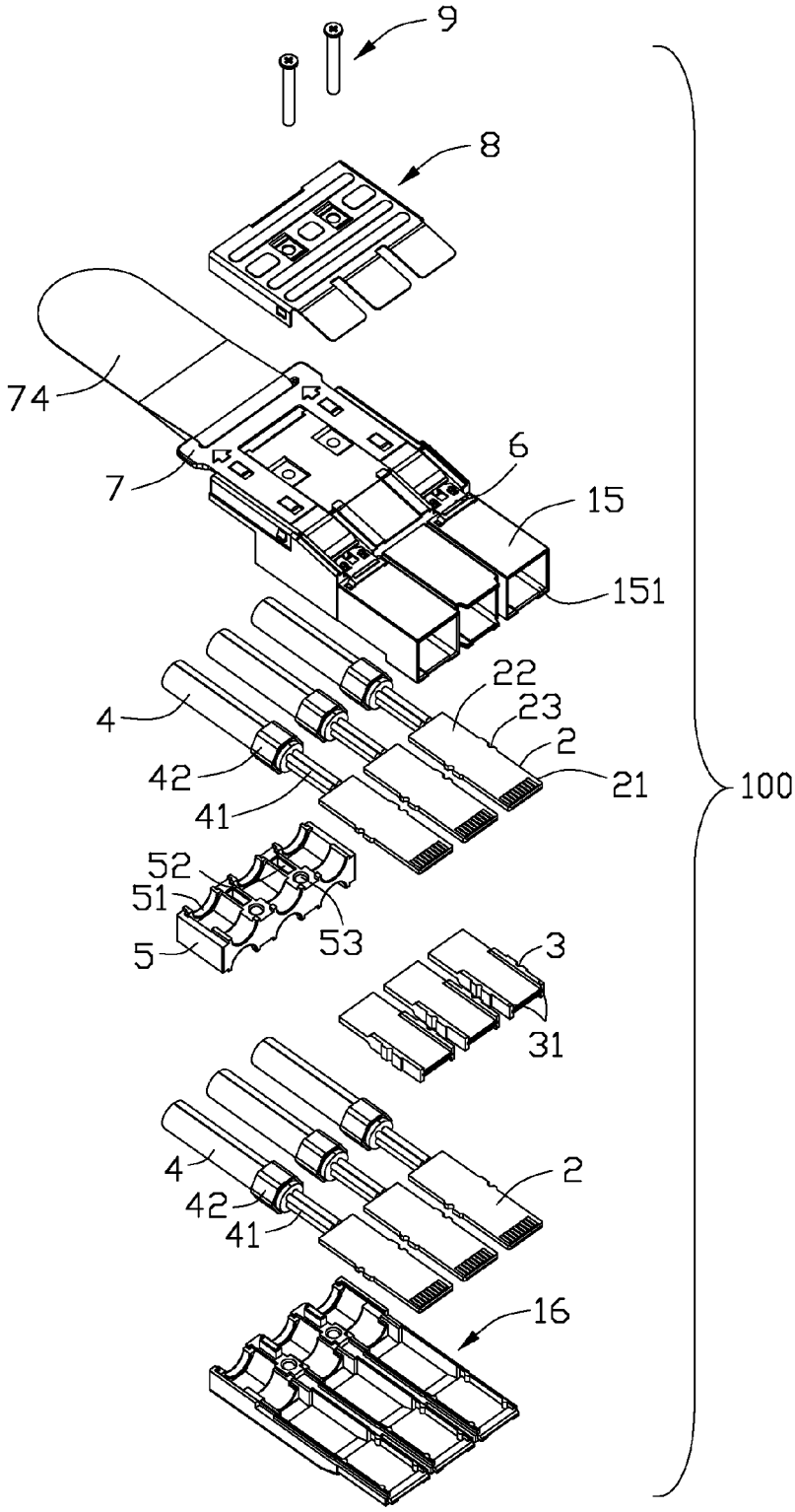
FIG. 6 is another partially assembled view of the electrical connector assembly of FIG. 1.
Figure 10:
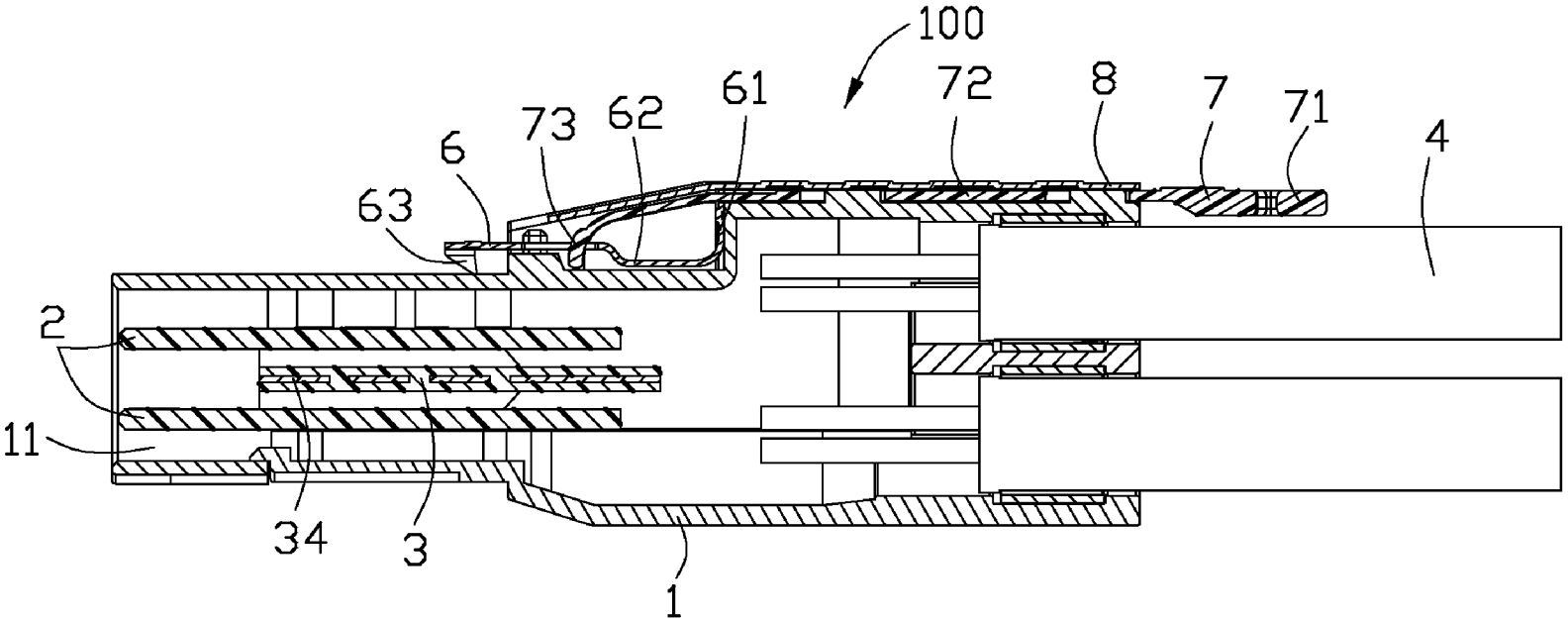
FIG. 10 is a cross section view of the electrical connector assembly of FIG. 1 taken along line 10-10.
Figure 12:
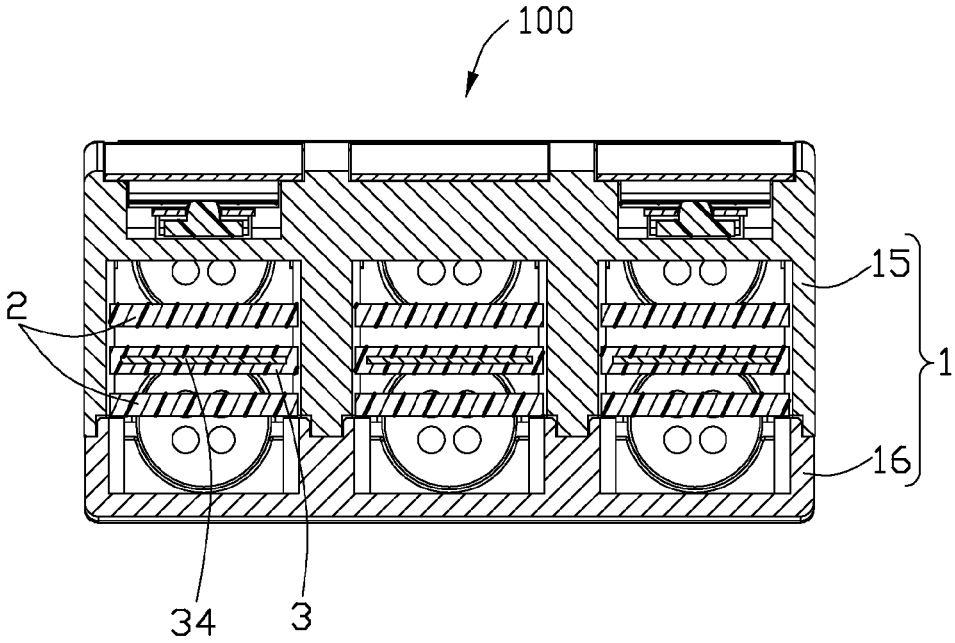
FIG. 12 is a cross section view of the electrical connector assembly of FIG. 1 taken along line 12-12.

Referring to FIG. 6 and in conjunction with FIGS. 10 and 12, six printed circuit boards 2 are disposed in the housing 1. Each of two printed circuit boards 2 are received into a receiving room 11. Each of the printed circuit board 2 has a mating section 21 formed on a front end thereof and a terminating section 22 formed on a rear end thereof. Each of the printed circuit board 2 defines a pair of slots 23 formed on two lateral sides for cooperating with the pair of second positioning posts 155 of the upper shield part 15.

Figure 7:
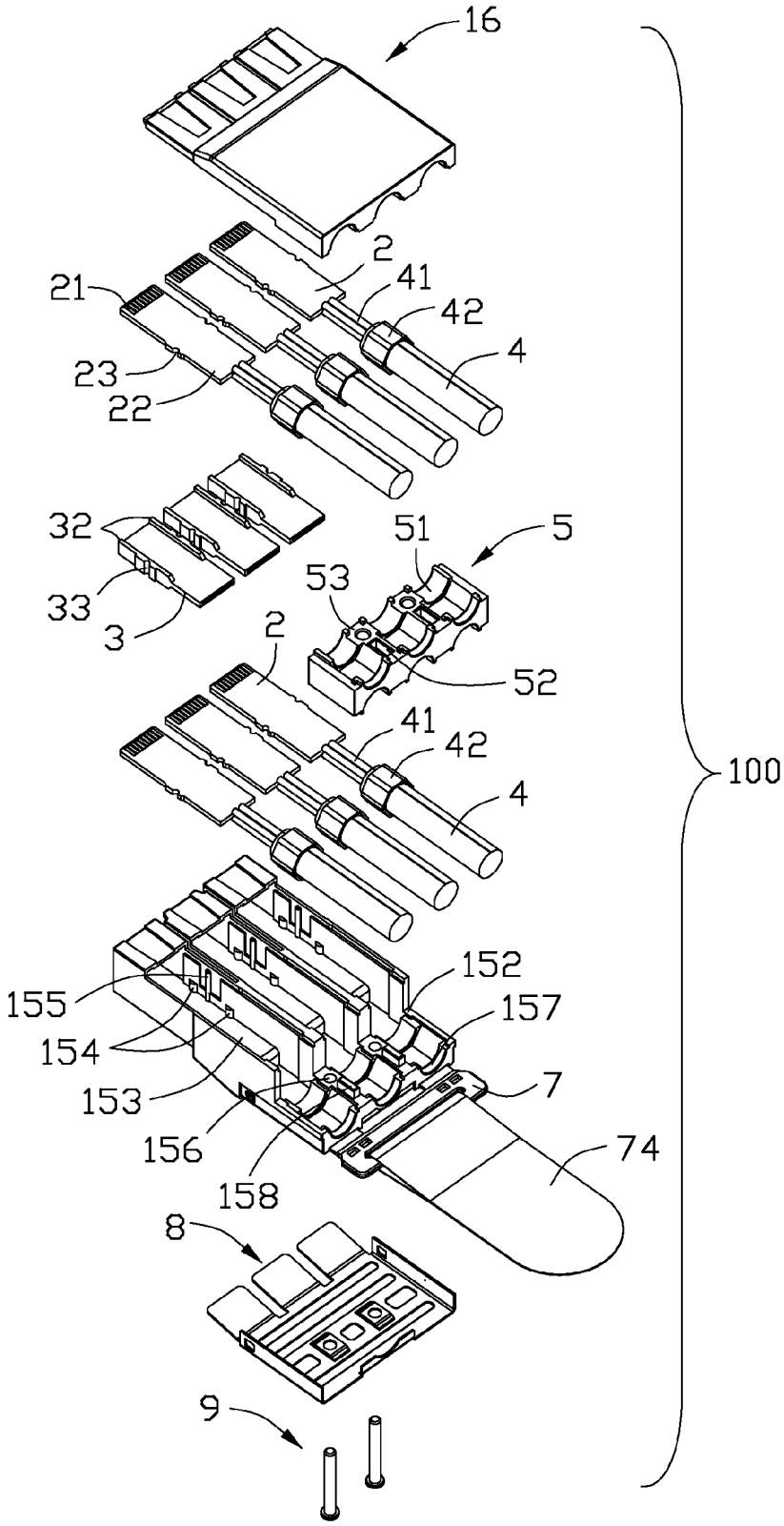
FIG. 7 is similar to FIG. 6, but viewed from another aspect.

Referring to FIGS. 6 and 7 and in conjunction with FIGS. 10 and 12, three spacers 3 are formed of insulative material and respectively sandwiched between two printed circuit boards 2 in a vertical direction. Each of the spacer 3 defines a pair of ribs 31 formed on a top surface thereof and another pair of ribs 32 formed on a bottom surface for supporting the printed circuit boards 2. The spacer 3 further defines a pair of grooves 33 respectively formed on two sides thereof and extending along a vertical direction for cooperating with two corresponding second positioning posts 155 formed in a receiving room 11 of the upper shield part 15. The spacer 3 further defines a grounding plate 34 integrative formed therein.

Figure 11:
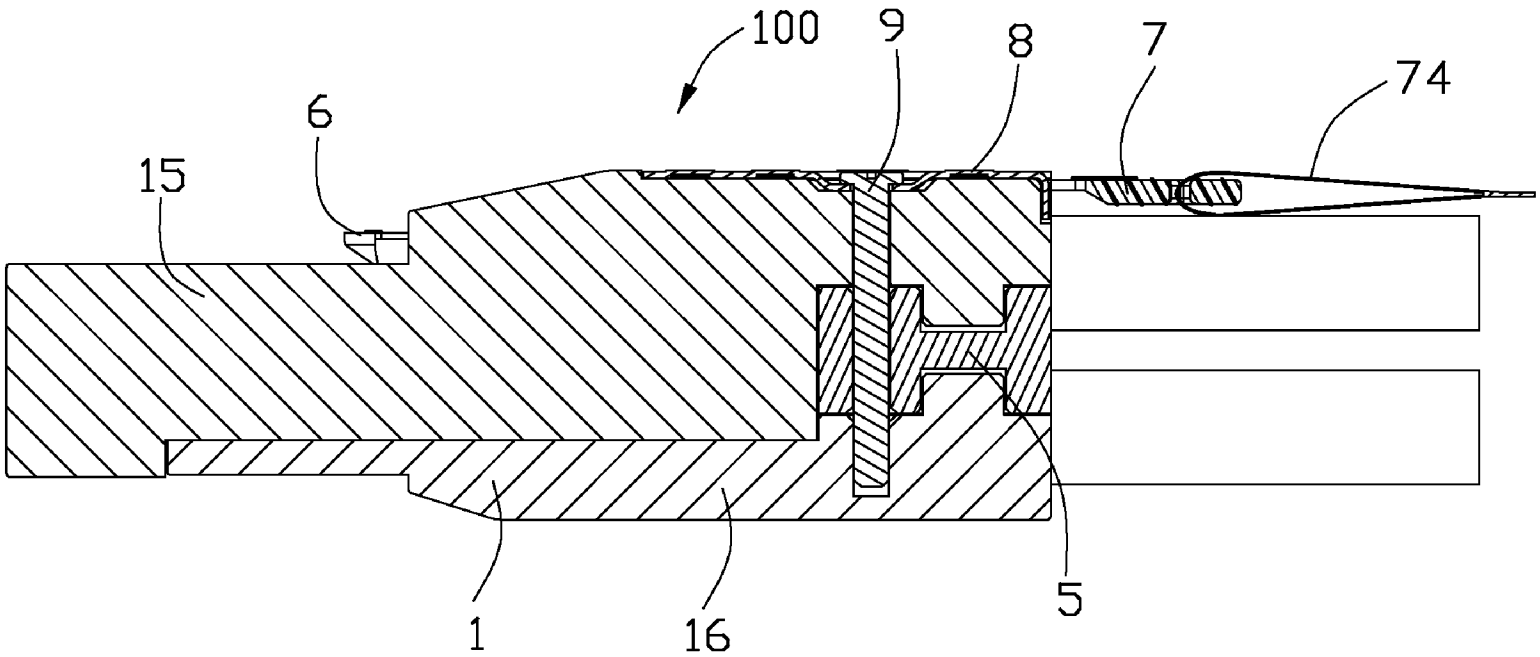
FIG. 11 is a cross section view of the electrical connector assembly of FIG. 1 taken along line 11-11.

Referring to FIGS. 6 to 7 and in conjunction with FIGS. 10 and 11, six cables 4 are respectively electrically and mechanically connected with six printed circuit boards 2. Each of the cable 4 has a plurality of conductors 41 formed therein and electrically connected to a terminating section 22 of the printed circuit board 2. A ring 42 is disposed at a front end of each cable 4 and surrounding a portion of the cable 4.

Referring to FIGS. 6 to 7 and in conjunction with FIG. 11, a strain relief 5 is made of metallic material and disposed in a rear area of the receiving rooms 11 housing 1. The strain relief 5 is sandwiched by the upper shield part 15 and the lower shield part 16. The strain relief 5 defines six recesses 51 respectively formed on a top and bottom surfaces thereof and corresponding to the six grooves 157, 162 of the upper and lower shield part 15, 16. Each recess 51 is used for supporting a cable 4 and receiving a portion of the ring 42 of the cable 4. The strain relief 5 defines two rectangular receiving slots 52 formed on top surface thereof and another two rectangular receiving slots 52 formed on bottom surface thereof. The receiving slots 52 are cooperated with the positioning projections 158, 163 of the upper and lower shield part 15, 16. The strain relief 5 further defines a pair of holes 53 in alignment with the through holes 156 and the receiving holes 161 along an up-to-down direction.

Figure 8:
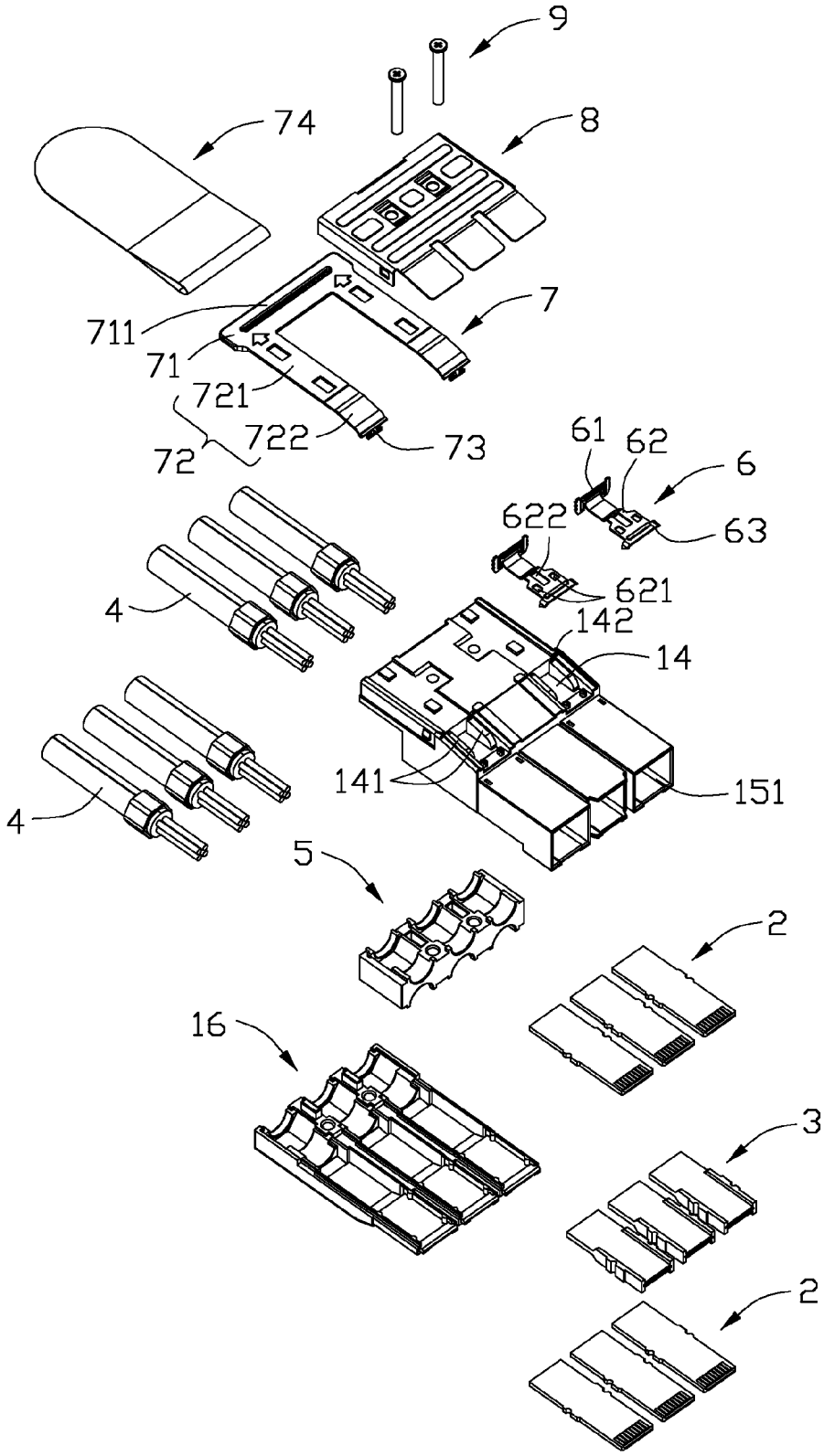
FIG. 8 is an exploded view of the electrical connector assembly of FIG. 1.
Figure 9:
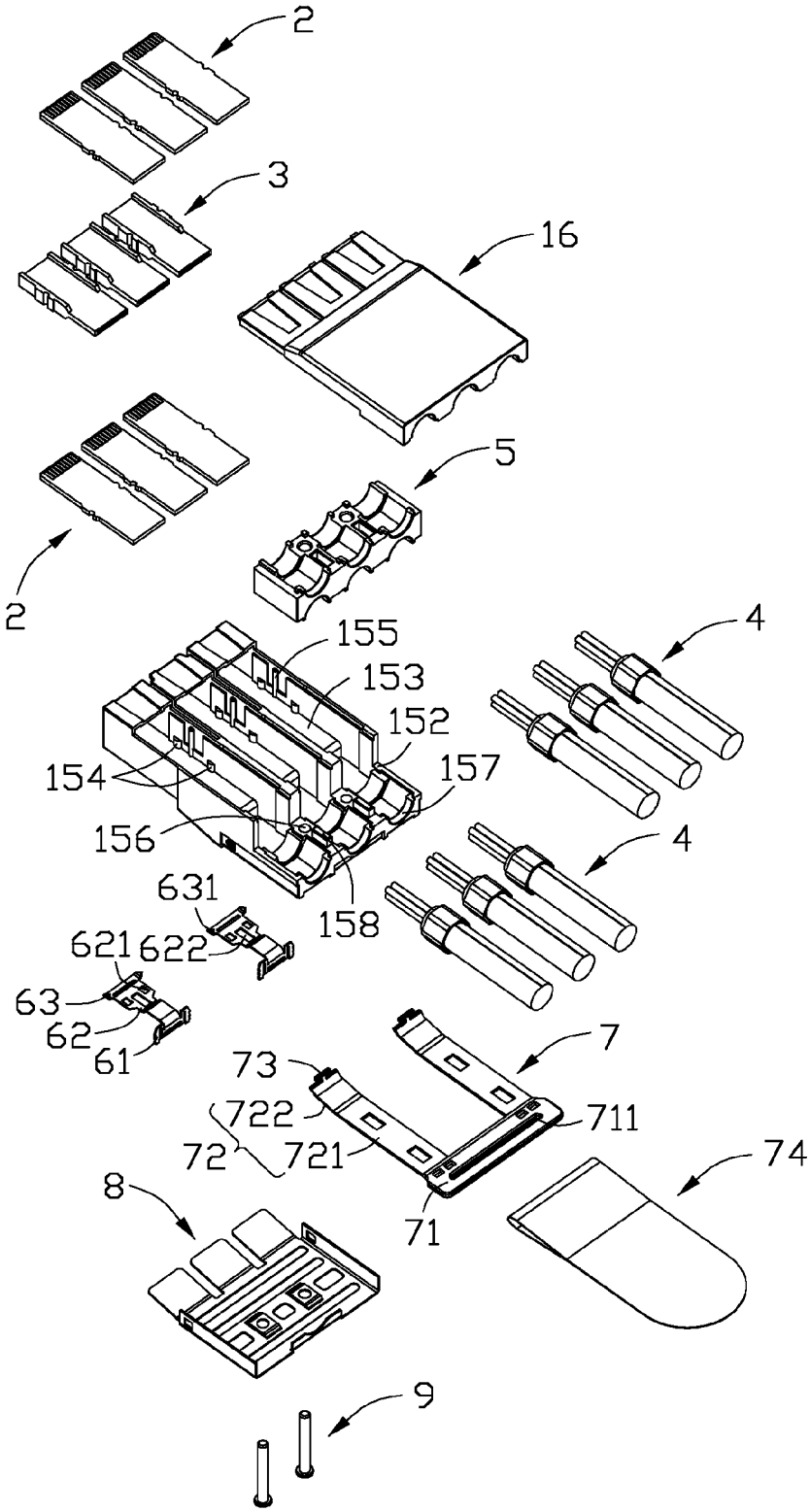
FIG. 9 is similar to FIG. 8, but viewed from another aspect.

Referring to FIGS. 8 to 10, two latching members 6 are respectively disposed in the two receiving cavities 14 of the housing 1. Each of the latching member 6 is stamped and formed from a metallic plate and comprises a vertical retaining portions 61, a connecting portion 62 extending forwardly from two bottom sides of the retaining portions 61 and a latching portion 63 extending forwardly from the connecting portion 62. A front portion of the latch 6 is defined as a latching portion 63. The connecting portion 62 defines a rectangular opening 622 and two quadrate openings 621 disposed at two sides of the rectangular opening 622. The latching portion 63 defines a pair of barbs 631 formed at two sides thereof.

Referring to FIGS. 8 to 10, the pulling member 7 is made of insulative material and structured in a flat shape. The pulling member 7 defines an operating section 71 disposed in rear end thereof, two T-shaped actuating sections 73 disposed in a front end thereof and two paralleled and spaced connecting sections 72 connecting the operating section 71 to the two actuating sections 73. Each connecting section 72 defines a horizontal section 721 connecting to the operating section 71 and a curving section 722 connecting to the actuating section 73. The operating section 71 has a slit 711. A tape 74 is passed through the slit 711 and connected to the pulling member 7.

Figure 4:
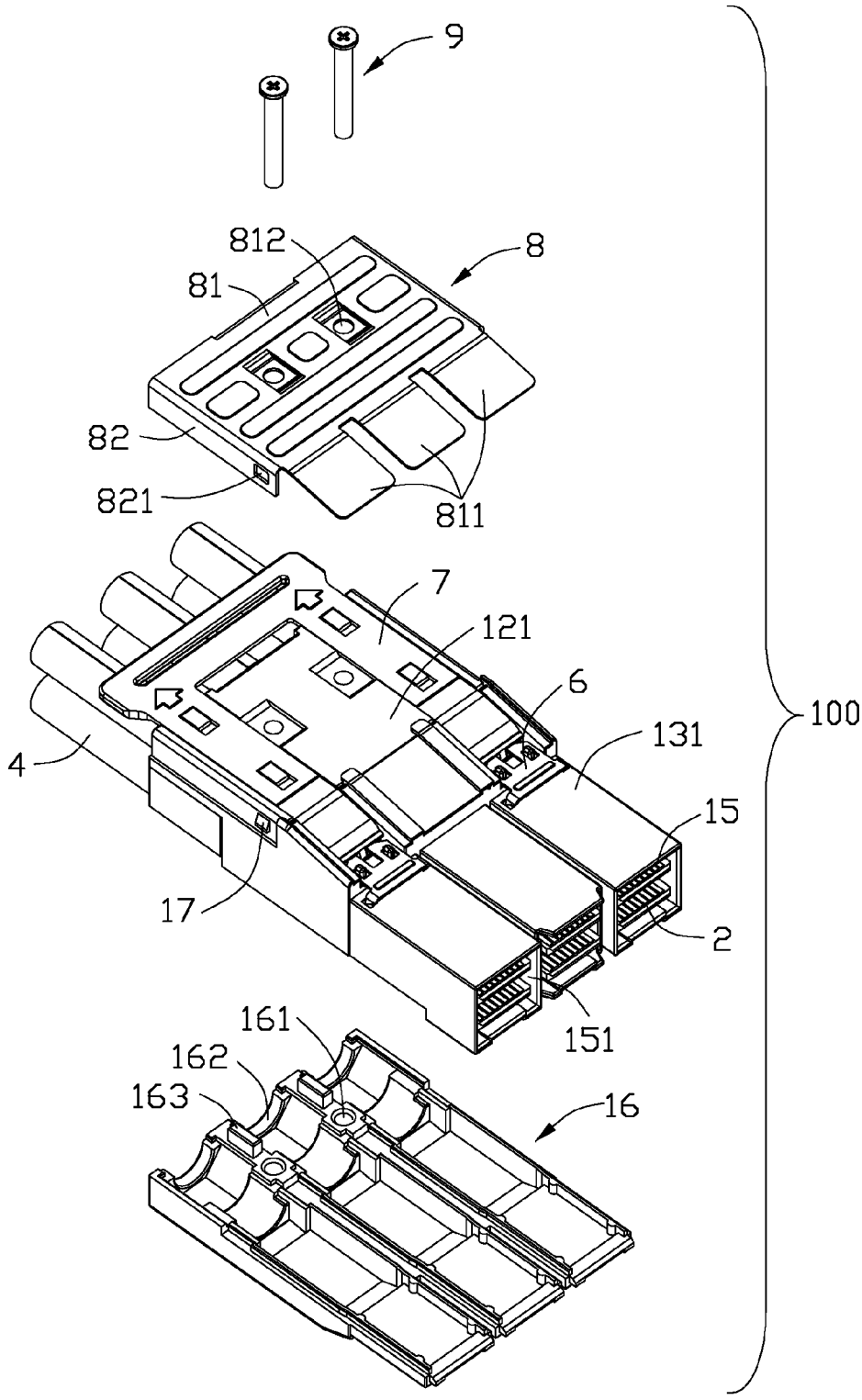
FIG. 4 is a partially assembled view of the electrical connector assembly of FIG. 1.
Figure 5:
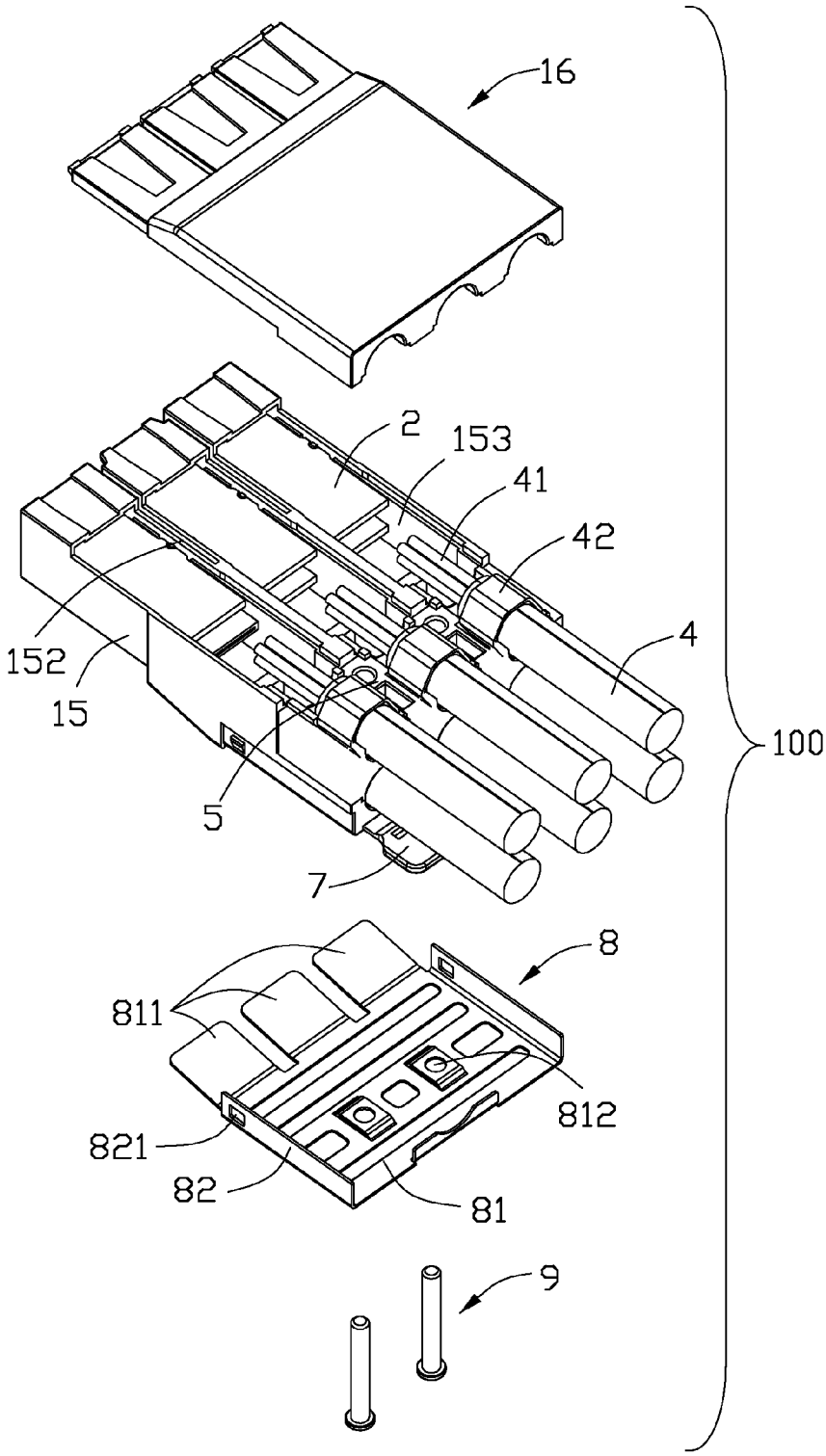
FIG. 5 is similar to FIG. 4, but viewed from another aspect.
Figure 13:
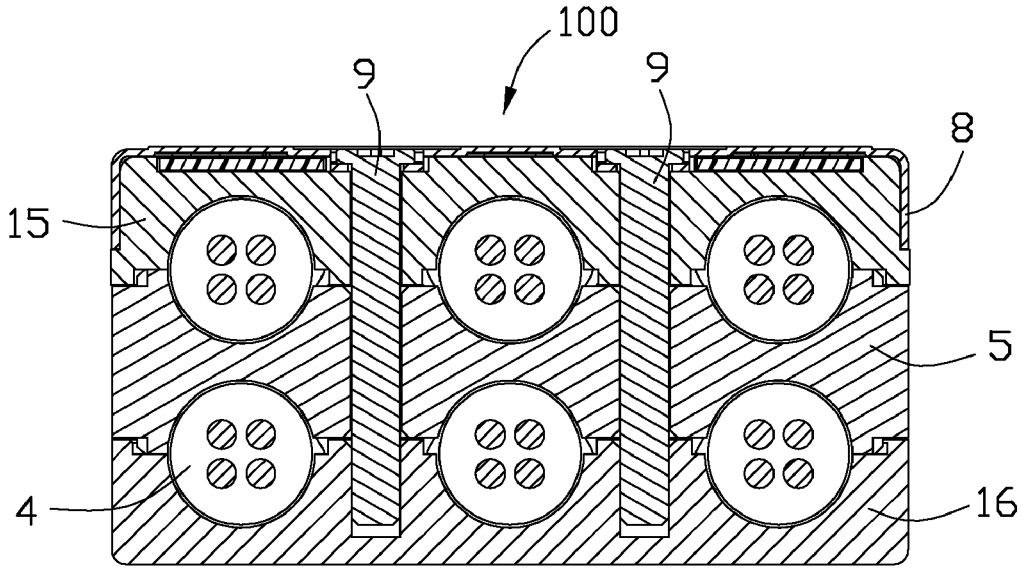
FIG. 13 is a cross section view of the electrical connector assembly of FIG. 1 taken along line 13-13.

Referring to FIGS. 3 to 5 and in conjunction with FIG. 13, the metallic holder 8 defines a top wall 81 for shielding a portion of the latch mechanism and a pair of side walls 82 extending downwardly from two sides of the top wall 81 for interlocking with the housing 1. The top wall 81 of the metallic holder 8 defines three inclined shielding pieces 811 and two holes 812 for two engaging means 9 passing through. Each side wall 82 defines a hole 821 cooperating with the wedge-shaped projection 17 of the housing 1. Engaging means 9 is a pair of screws and can be assembled to the housing 1 along an up-to-down direction. The upper shield part 15, the lower shield part 16 and the strain relief 5 are interconnected with each other by the engaging means 9.

Referring to FIGS. 1 to 13, the assembling process of the electrical connector assembly 100 made in according to the present invention starts from soldering the conductors 41 of each cable 4 respectively to the terminating section 22 of each printed circuit board 2. Thus, six combinations of the cable 4 and the printed circuit board 2 are formed.

After the six cables 4 are terminated to the six printed circuit boards 2, then turning over the upper shield part 15 to make the cutout 152 and three passageways 153 facing upward. Then, assembling three combinations of the printed circuit boards 2 and the cables 4 respectively into the three passageways 153 through the cutout 152. Each printed circuit board 2 is supported by the first positioning posts 154 of the upper shield part 15 along a vertical direction. And, the printed circuit board 2 is engaged with the upper shield part 15 along a front-to-rear direction due to the pair of slots 23 of the printed circuit board 2 cooperated with the pair of second positioning posts 155 of the upper shield part 15. And, a front end of each cable 4 is received into the groove 157 of the upper shield part 15. A portion of the ring 42 of the cable 4 is also received into the groove 157.

After three combinations of the cable 4 and the printed circuit board 2 are assembled to the upper shield part 15, then assembling a strain relief 5 to a rear end of the cutout 152 of the upper shield part 151. Thus, the two positioning projections 158 are received into the two receiving slots 52 of the strain relief 5. And, each ring 42 of the cable 4 is received into a room formed by the upper shield part 15 and the strain relief 5.

After the strain relief 5 is assembled to the upper shield part 15, then assembling three spacers 3 to the three passageways 153 of the upper shield part 15. The spacer 3 is positioned with the upper shield part 151 and located on the printed circuit board 2. The pair of second positioning posts 155 of the upper shield part 15 pass through the corresponding two grooves 33 of the spacer 3 along an up-to-down direction to limit a movement of each spacer 3 along a front to rear direction.

After three spacers 3 are assembled to the upper shield part 15, then assembling another three combinations of the printed circuit board 2 and cable 4 to the three passageways 153 of the upper shield part 15. Each of the printed circuit board 2 is engaged with the upper shield part 15 along a front-to-rear direction due to the pair of slots 23 of the printed circuit board 2 cooperated with the pair of second positioning posts 155 of the upper shield part 15. The ring 42 of each cable 4 has a portion received into a recess 51 of the strain relief 5.

Then assembling the lower shield part 16 to the upper shield part 15. Thus, the cutouts 12 of the upper shield part 15 are shielded by the lower shield part 16 along an up-to-down direction. The printed circuit boards 2 are also positioned in the housing 1 by the lower shield part 16. Through the above assembling steps, the six printed circuit boards 2, a strain relief 5 and three spacers 3 are received into the housing 151.

After the lower shield part 16 is assembled to the upper shield part 15, then assembling the pair of latching members 6 to the pulling member 7 through following steps. Firstly, each latching member 6 is disposed in front of the actuating section 73 of the pulling member 7 and arranged perpendicular to the actuating section 73 of the pulling member 7. Secondly, each actuating section 73 of the pulling member 7 is passed through the rectangular opening 622 the latching member 6 and located below the latching member 6. Thirdly, the latching member 6 is rotated 90 degree to make the latching member 6 in alignment with the connecting section 72 of the pulling member 6. Thus, the pair of latching members 6 are interconnected with the pulling member 7. And, the latching member 6 is not easily discrete from the pulling member 7 due to the width of the actuating section 73 is wider than a width of the rectangular opening 622.

Then, assembling the pair of latching members 6 and the pulling member 7 together to an exterior surface of housing 1. The connecting section 72 of the pulling member 7 is located on the first surface 121 of the body portion 12 of the housing 1. The curving section 722 of the connecting section 72 of the pulling member 7 is supported by the two supporting portions 141 formed in the receiving cavity 14. The rear operating section 71 of the pulling member 7 extends rearwardly beyond the rear surface of the housing 1. In addition, each latching member 6 is received into a receiving cavity 14. Thus, the retaining portion 61 of each latching member 6 is received into the slit 144 to make the latching member 6 positioned to the housing 1. The connecting portion 62 of the latching member 6 is located above the bottom surface 141 of the receiving cavity 14. The latching portion 63 extends forwardly and is located above the second surface 131 of the mating portion 13 of the housing 1. The latching portion 63 is cantilevered from the retaining portion 61. A tape 74 is passed through the slit 711 and connected to the pulling member 7. When a rearward pulling force is exerted on a rear end of the pulling member 7 or the tape 74, the latching portion 63 of the latching member 6 will be raised up. When the rearward pulling force is released, the latching portion 63 of the latching member 6 will resume to an original state.

Then, assembling a metallic shield 8 to the top surface 121 of the body portion 12 of the housing 1. And, a portion of the pair of latching members 6 and the pulling member 7 is shielded by the metallic shield 8. Two holes 821 of the metallic shield 8 are respectively cooperated with two wedge-shaped projections 17. Thus, the metallic shield 8 is firmly engaged to the housing 1.

Finally, assembling engaging means 9 to the housing 1 to interlock the metallic shield 8, the upper shield part 15, the strain relief 5 and the lower shield part 16 together. The engaging means 9 is passed through two holes 812 of metallic shield 8, two through holes 156 of the upper shield part 15, two through holes 53 the strain relief 5 and received into the receiving holes 161 of lower shield part 16.

After the above assembling steps, the entire process of assembling of the electrical connector assembly 100 is finished. The electrical connector assembly 100 has a new mating surface to meet higher and higher data transmitting rate. On another aspect, a reliable latch mechanism is provided to an exterior surface of the housing. Two latching members 6 are operated by one pulling member 7. Thus, an easily and conveniently operating manner between the pair of latching members 6 and the pulling member 7 is achieved.

Figure 14:
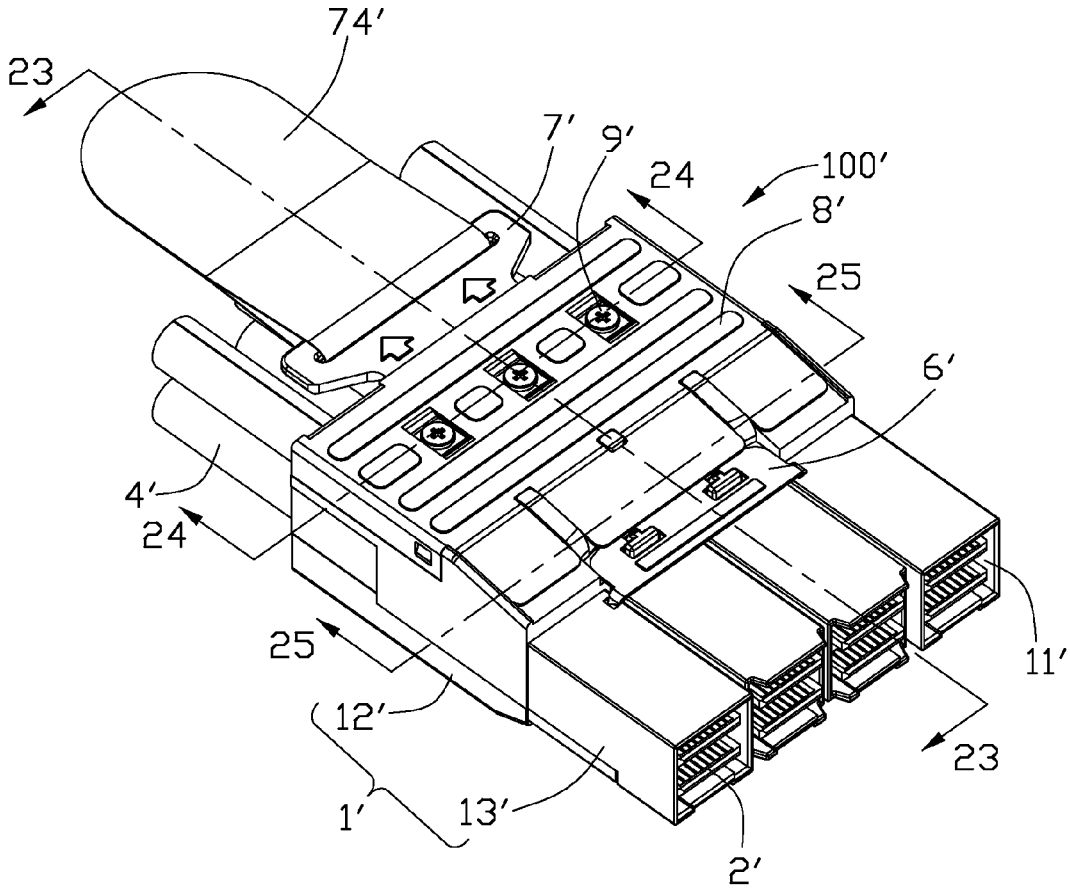
FIG. 14 is a perspective view of an electrical connector assembly in accordance with a second embodiment of the present invention.
Figure 15:
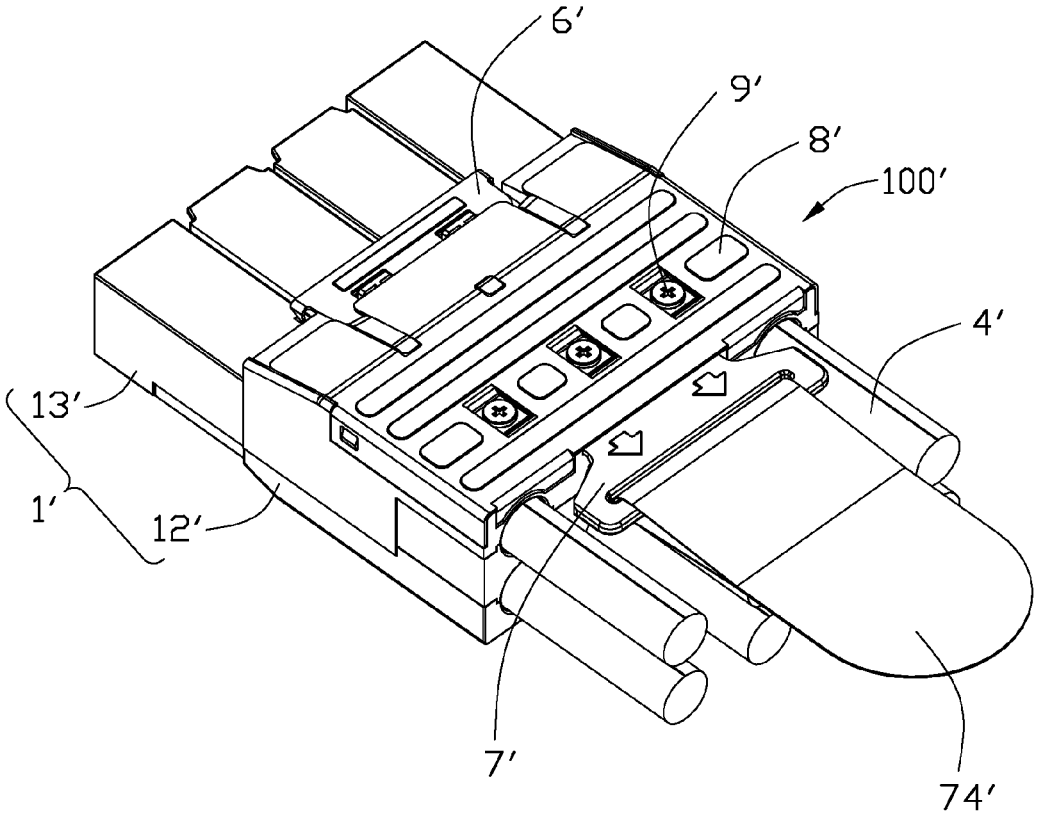
FIG. 15 is another perspective view of the electrical connector assembly of FIG. 14.
Figure 16:
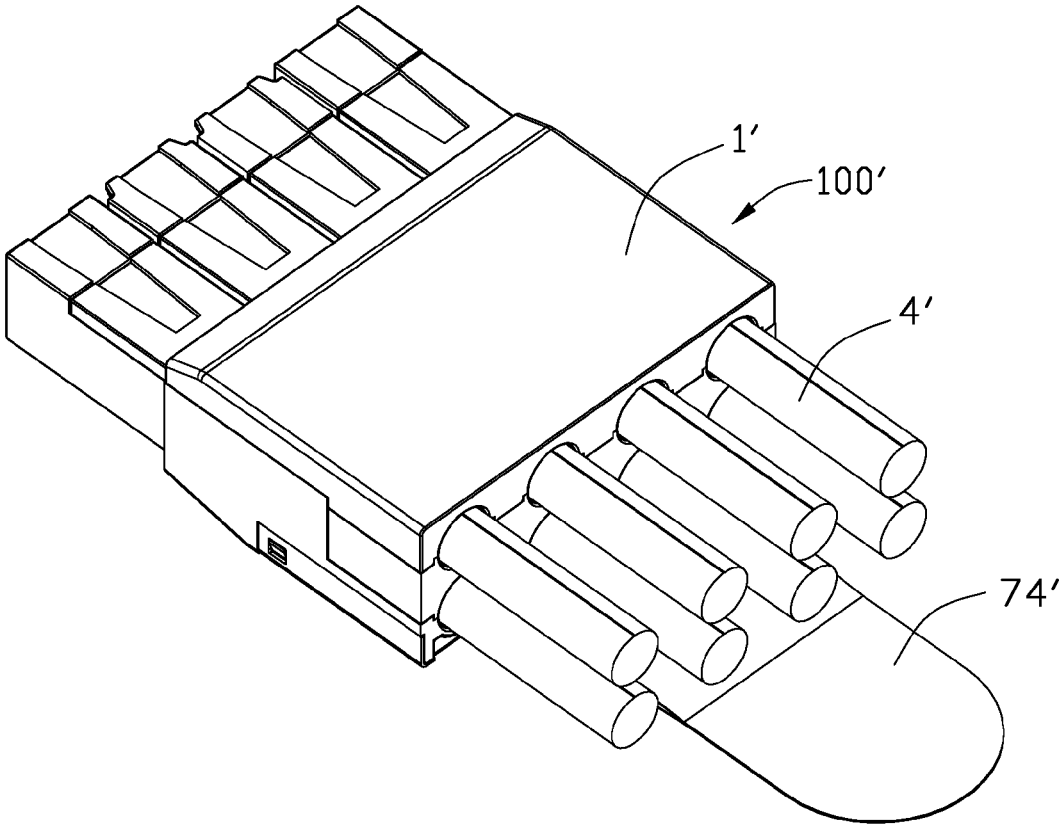
FIG. 16 is another perspective view of the electrical connector assembly of FIG. 15.

FIGS. 14 to 16 illustrate perspective views of an electrical connector assembly 100' made in accordance with a second embodiment of the present invention. Referring to FIGS. 17 to 25, the electrical connector assembly 100' comprises a housing 1' having four receiving rooms 11' formed therein and spaced apart with each other, eight printed circuit boards (PCBs) 2' received into the four receiving rooms 11', four spacers 3' respectively disposed in the four receiving rooms 11', eight cables 4' respectively electrically connected with eight printed circuit boards 2', a strain relief 5' disposed in the housing 1' and three engaging means 9' interconnecting the strain relief 5' to the housing 1'. The electrical connector assembly 100' further comprises a latch mechanism assembled to a top surface of the housing 1' and a metallic shield 8' shielding a portion of the housing 1 and the latch mechanism. The latch mechanism comprises a latching member 6' and a pulling member 7' interconnected with each other. A tape 74' is connected to a rear end of the pulling member 7'.

FIGS. 14 to 16 illustrate perspective views of an electrical connector assembly 100' made in accordance with a second embodiment of the present invention. Referring to FIGS. 17 to 25, the electrical connector assembly 100' comprises a housing 1' having four receiving rooms 11' formed therein and spaced with each other, eight printed circuit boards (PCBs) 2' received into the four receiving rooms 11', four spacers 3' respectively disposed in the four receiving rooms 11', eight cables 4' respectively electrically connected with eight printed circuit boards 2', a strain relief 5' disposed in the housing 1' and two engaging means 9' interconnecting the strain relief 5' to the housing 1'. The electrical connector assembly 100' further comprises a latch mechanism assembled to a top surface of the housing 1' and a metallic shield 8' shielding a portion of the housing 1' and the latch mechanism. The latch mechanism comprises a latching member 6' and a pulling member 7' interconnected with each other. A tape 74' is connected to a rear end of the pulling member 7'.

Figure 19:
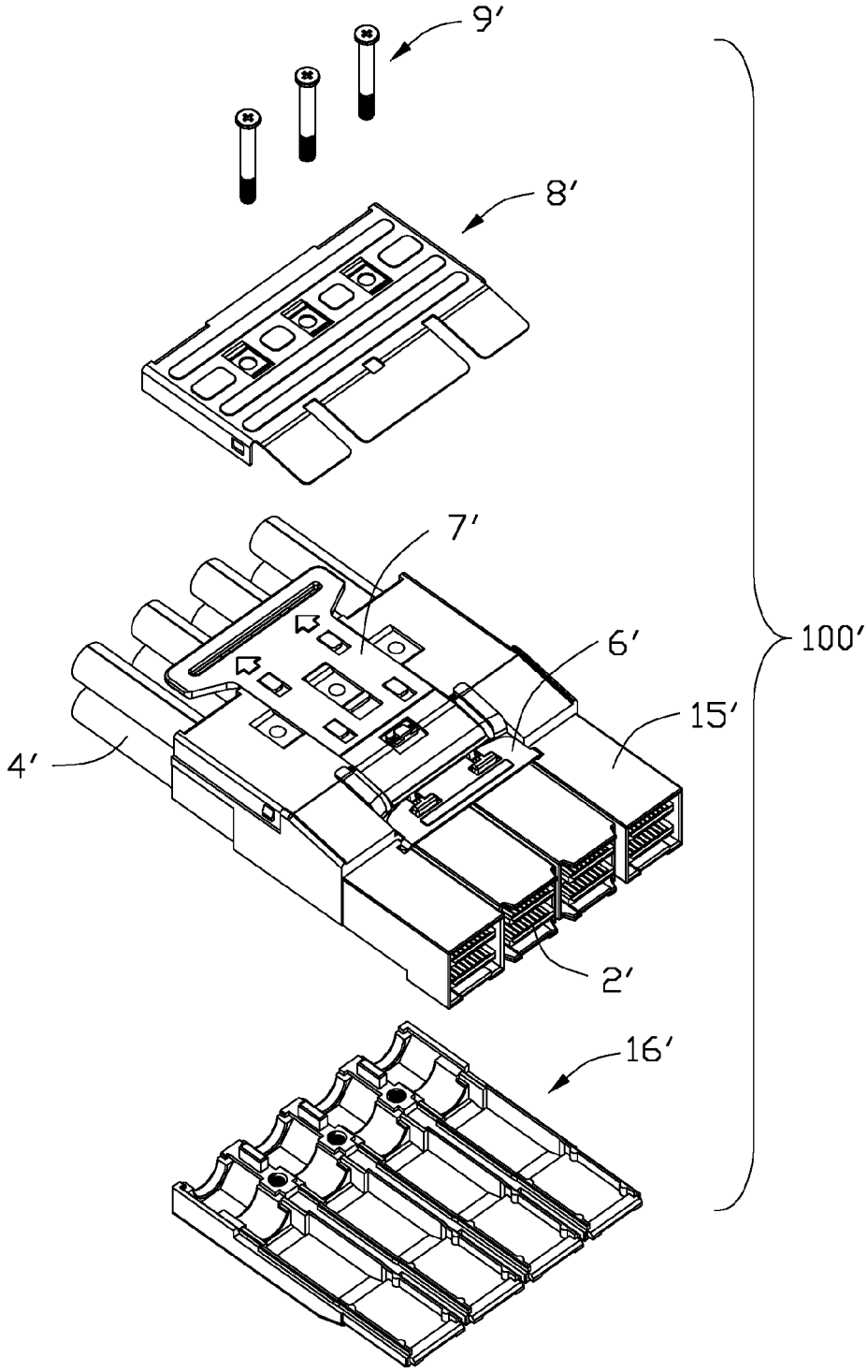
FIG. 19 is another partially assembled view of the electrical connector assembly of FIG. 14.
Figure 20:
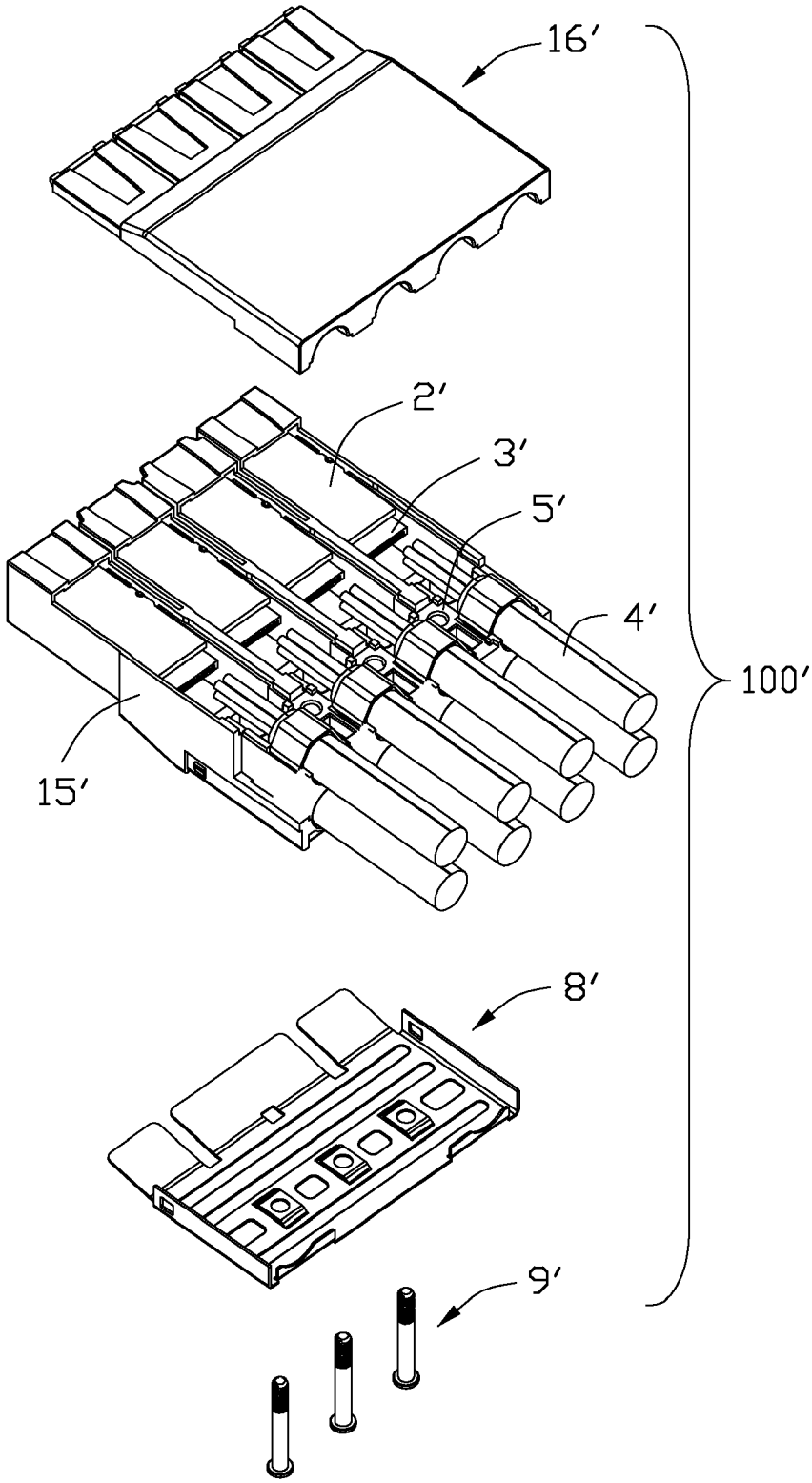
FIG. 20 is similar to FIG. 19, but viewed from another aspect.

Referring to FIGS. 15 to 16 and in conjunction with FIGS. 19 and 20, the housing 1' of the electrical connector assembly 100' made in accordance with a second embodiment of the present invention has a similar structure to the housing 1 of the electrical connector assembly 100 made in accordance with a first embodiment of the present invention. The housing 1' defines a body portion 12' and a mating portion 13' extending forwardly from the body portion 12'. The housing 1' also comprises an upper shield part 15' and a lower shield part 16'. The housing 1' defines some positioning structure for positioning the printed circuit board 2' and the spacer 3' same to the corresponding structure formed in the housing 1. The housing 1' also defines some positioning structure for supporting the cable 4' and the strain relief 5' same to the corresponding structure formed in the housing 1. Other structure formed in the housing 1' and same to the corresponding structure formed in the housing 1 will not be described in detail.

Figure 21:
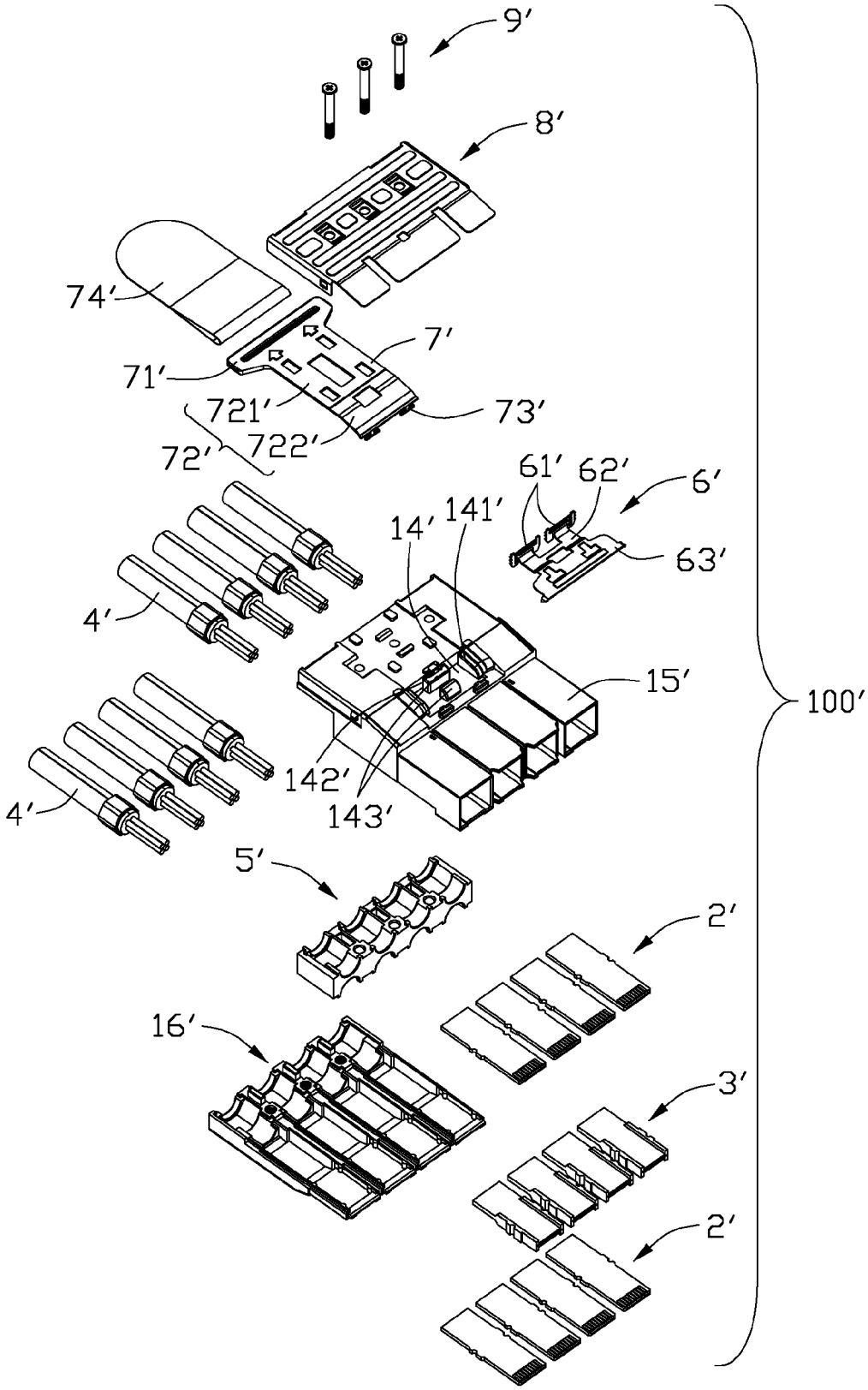
FIG. 21 is an exploded view of the electrical connector assembly of FIG. 1.
Figure 22:
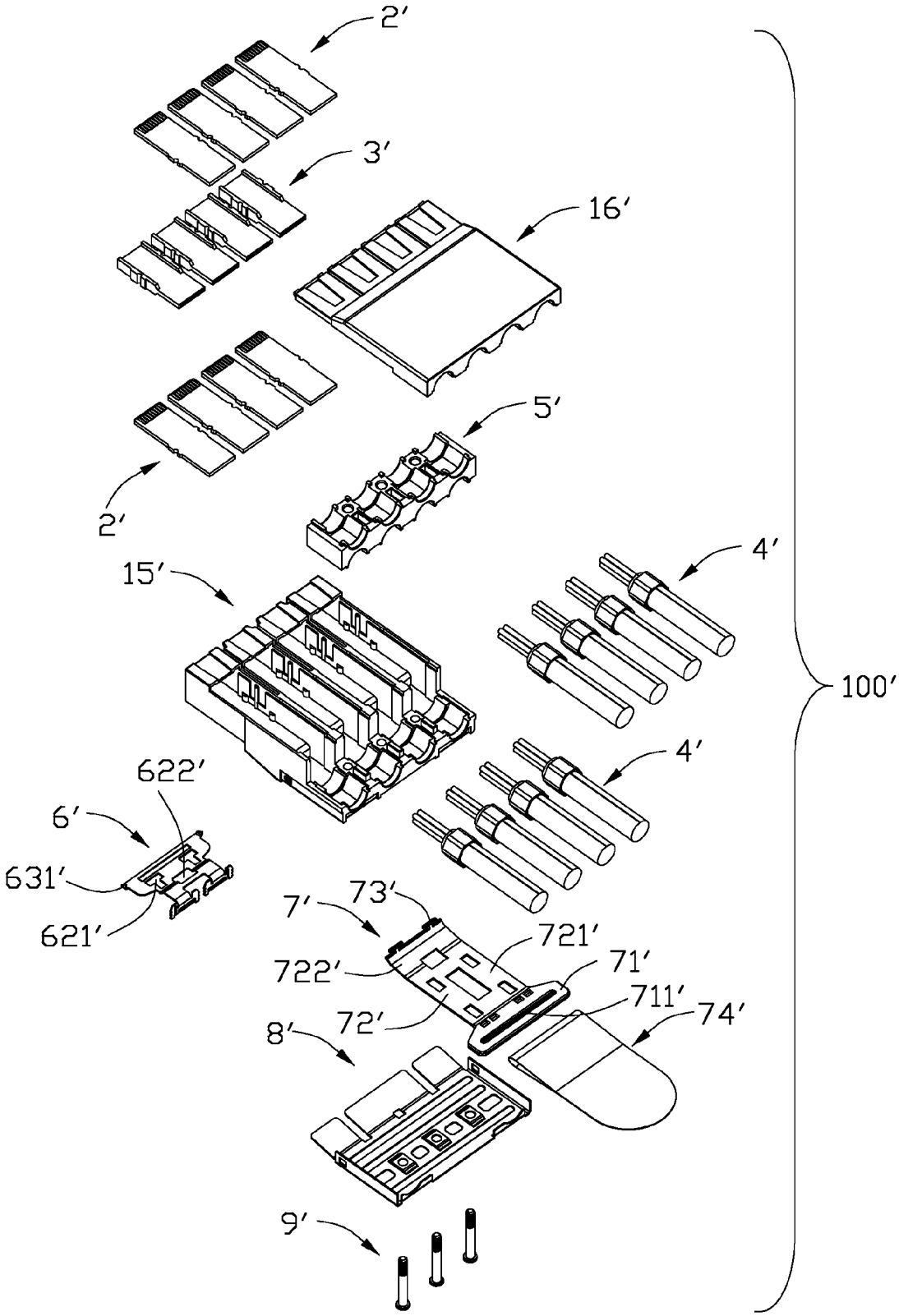
FIG. 22 is similar to FIG. 21, but viewed from another aspect.
Figure 23:
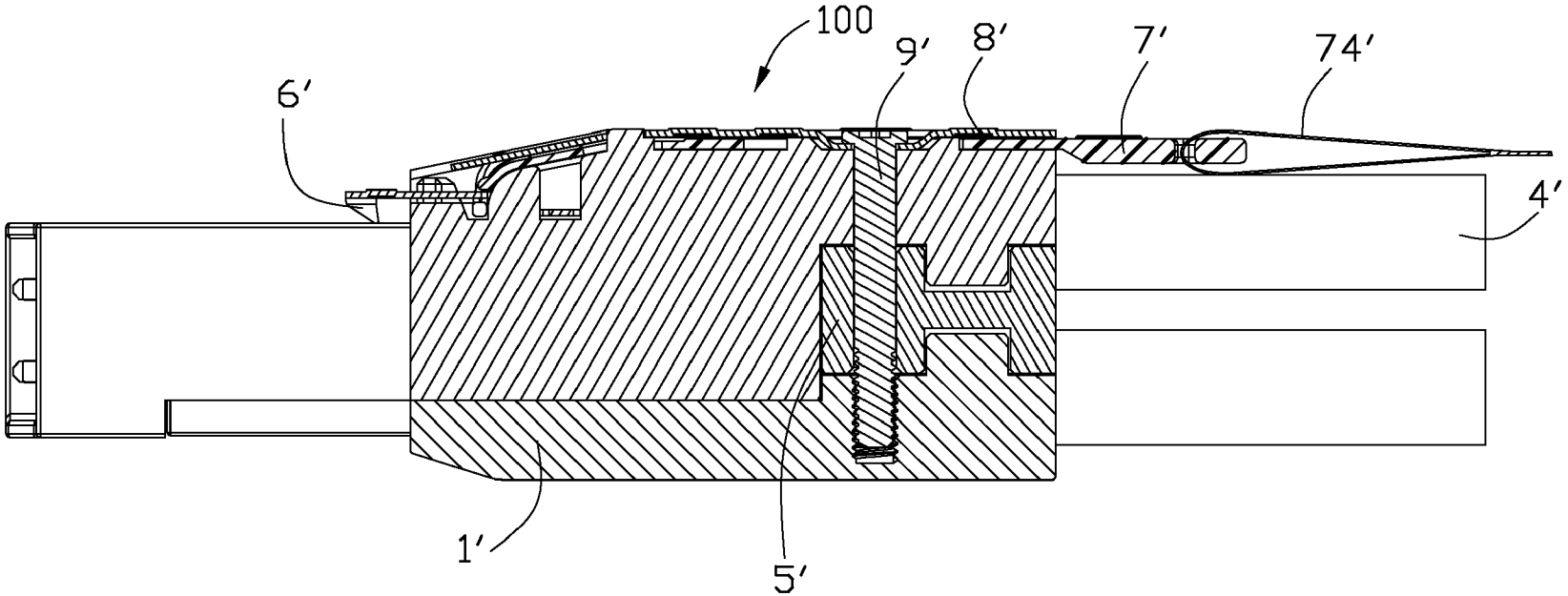
FIG. 23 is a cross section view of the electrical connector assembly of FIG. 14 taken along line 23-23.
Figure 24:
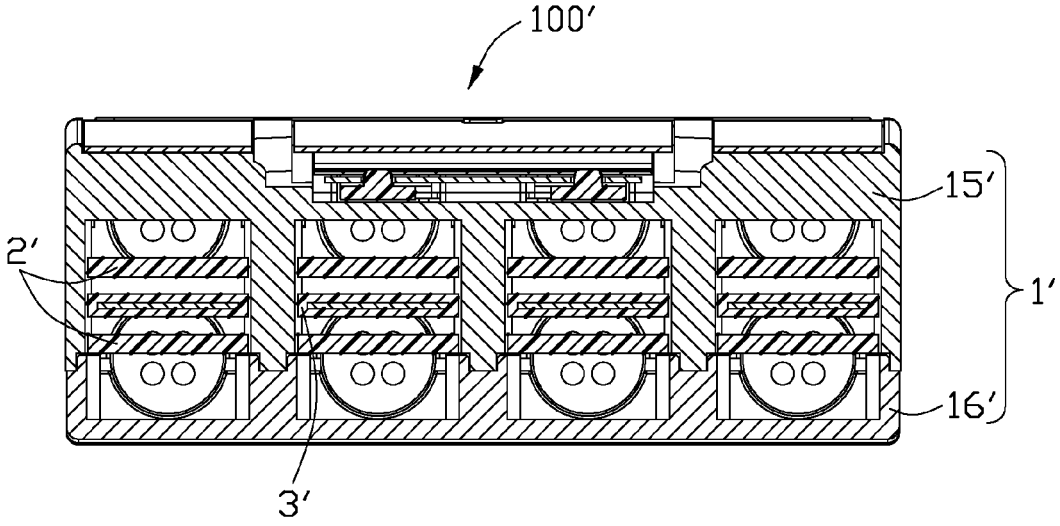
FIG. 24 is a cross section view of the electrical connector assembly of FIG. 14 taken along line 24-24.
Figure 25:
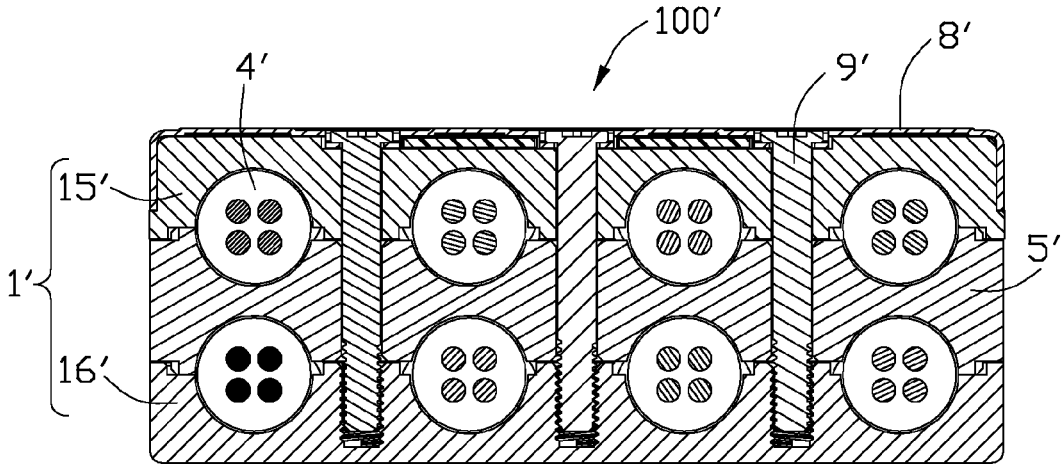
FIG. 25 is a cross section view of the electrical connector assembly of FIG. 14 taken along line 25-25.

Referring to FIGS. 21 and 22, the housing 1' of the electrical connector assembly 100' has some different structure to the housing 1 of the electrical connector assembly 100. The housing 1' has four receiving rooms 11' more than three receiving rooms 11 of the housing 1. So, eight printed circuit boards 2' can be received into the housing 1'. And the housing 1' has a width larger than that of the housing 1'. In addition, the housing 1' defines a receiving cavity 14' formed on a top surface 121' of the body portion 12' of the housing 1'. A pair of first supporting portions 141' are formed on two inner side surfaces of the receiving cavity 14' for supporting a portion of the pulling member 7'. Two second supporting portions 143' are disposed in a middle section of the receiving cavity 14' and arranged along a front-to-rear direction for supporting a portion of the pulling member 7'. Two spaced slits 142' are respectively formed in back of the receiving cavity 14' and communicated with the receiving cavity 14'. The receiving cavity 14' is used for receiving the latching member 6'. So, the structure of the top surface 121' of the body portion 12' of the housing 1' is different from the structure of the top surface 121 of the body portion 12 of the housing 1.

Referring to FIGS. 21 and 22, the printed circuit board 2', the spacer 3' and the cable 4' of the electrically connector assembly 100' respectively has same structure to the printed circuit board 2, the spacer 3 and the cable 4 of the electrically connector assembly 100. And, the strain relief 5' has a similar structure to the strain relief 5. The strain relief 5' has a width larger than that of the stain relief 5. The metallic shield 8' has a similar structure to the metallic shield 8. The metallic shield 8' has a width larger than that of the metallic shield 8. Each engaging mean 9 has a same structure with the engaging mean 9'. The upper shield part 15', the lower shield part 16' and the strain relief 5' are interconnected with each other through the engaging means 9'.

Figure 17:
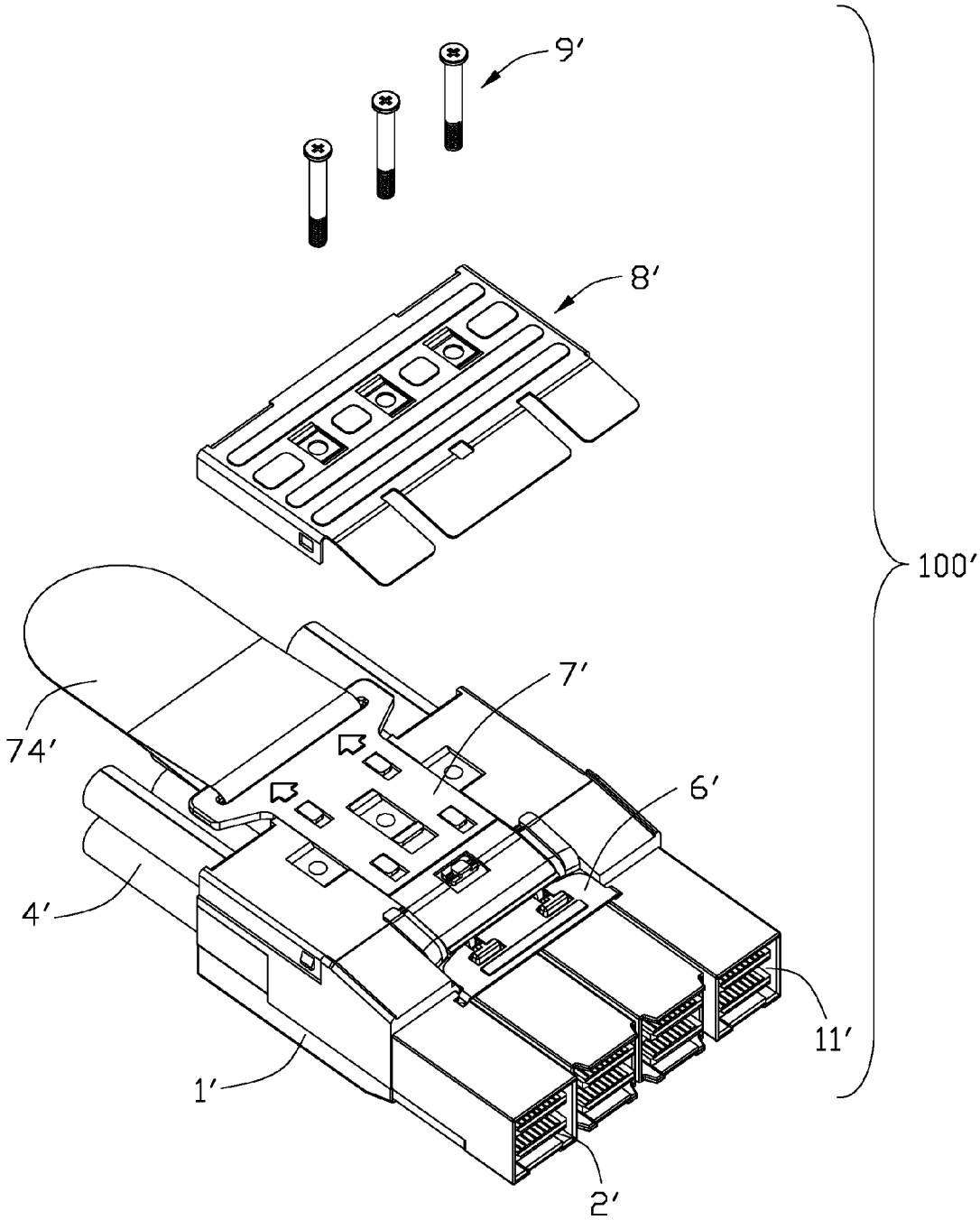
FIG. 17 is a partially assembled view of the electrical connector assembly of FIG. 14.
Figure 18:
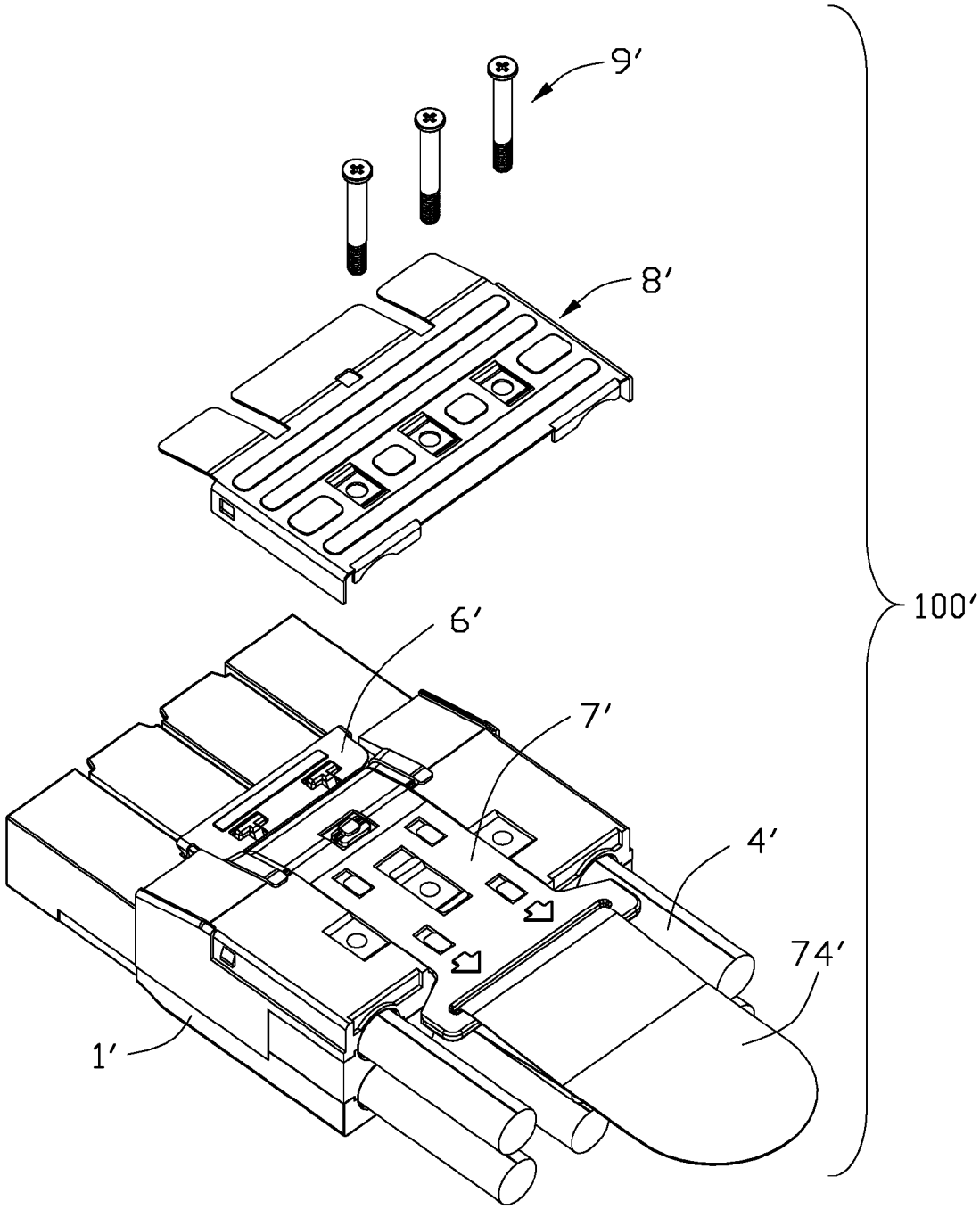
FIG. 18 is similar to FIG. 17, but viewed from another aspect.

Referring to FIGS. 17 and 21, the latching member 6' and the pulling member 7' of the electrically connector assembly 100' respectively has different structure to the latching member 6 and the pulling member 7 of the electrically connector assembly 100. The structure of the latching member 6' and the pulling member 7' are described in detail as below.

Referring to FIGS. 17 to 22, the latching member 6' is stamped and formed from a metallic plate and comprises two spaced vertical retaining portions 61', a connecting portion 62' extending forwardly from two bottom sides of the two retaining portions 61' and a latching portion 63' extending forwardly from the connecting portion 62'. A front portion of the latch 6' is defined as a latching portion 63'. The connecting portion 62' defines a rectangular opening 622' and two T-shaped openings 621' disposed in front of the rectangular opening 622'. Two retaining portions 61' are respectively received into the two spaced slits 142'. The connecting portion 62' is located above a bottom surface of the receiving cavity 14'. The latching portion 63' is extended out of the body portion 12' and located above the mating portion 13'.

Referring to FIGS. 17 to 22, the pulling member 7' is made of insulative material and structured in a flat shape. The pulling member 7' defines an operating section 71' formed on a rear end thereof, a pair of T-shaped actuating sections 73' formed on a front end thereof, and a connection section 72' connecting the operating section 71' to the two actuating sections 73'. The connecting section 72' comprises a horizontal section 721' connected to the operating section 71' and a curving section 722' connected to the two actuating sections 73'. The operating section 71' defines a slit 711'. A tape 74' is attached to the pulling member 7' through the slit 711'. The pulling member 7' is connected to the latching member 6' through following steps. Firstly, the latching member 6' is disposed in front of pulling member 7' and arranged perpendicular to the pulling member 7'. Secondly, the two actuating section 73' of the pulling member 7' are passed through the T-shaped openings 621' of the latching member 6' and located below the latching member 6'. Thirdly, the latching member 6' is rotated 90 degree to make the latching member 6' and the pulling member 7' in line. Thus, the latching member 6' is interconnected with the pulling member 7'. And, the latching member 6' is not easily discrete from the pulling member 7' due to the width of the actuating section 73' is wider than a width of a rear portion of the T-shaped opening 621'. When a rearward pulling force is exerted on a rear end of the pulling member 7' or the tape 74', the latching portion 63' of the latching member 6' will be raised up. When the rearward pulling force is released, the latching portion 63' of the latching member 6' will resume to an original state.

The assembling steps of the electrical connector assembly 100' is same to the assembling steps of the electrical connector assembly 100. The electrical connector assembly 100' has a new mating surface to meet higher and higher data transmitting rate. On another aspect, a reliable latch mechanism is provided to an exterior surface of the housing. A latching members 6' is operated by a pulling member 7'. Thus, an easily and conveniently operating manner between the pair of latching members 6' and the pulling member 7' is achieved.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

a housing having therein at least three receiving rooms extending along a front-to-rear direction and communicating with an exterior;

two printed circuit boards received into each of receiving room and positioned in the housing;

a strain relief disposed in the housing;

a latch mechanism assembled to an exterior surface of the housing; and engaging means assembled to the housing along a vertical direction to interlock the strain relief to the housing; wherein the electrical connector assembly further comprises a spacer disposed between each of the two printed circuit boards, and the spacer further defines a grounding plate integrative formed therein; wherein the latch mechanism comprises a pair of latching members and a pulling member; wherein the pulling member has an operating section, two actuating sections respectively connected to the pair of latching members and two connecting sections respectively connecting each actuating section to the operating section; wherein the pair of latching members are operated in a lever manner when the pulling member is moveable in a horizontal direction.

2. The electrical connector assembly as recited in claim 1, wherein the electrical connector assembly further comprises a metallic shield assembled to the housing and shielding a portion of the latch mechanism.

3. The electrical connector assembly as recited in claim 1, wherein the electrical connector assembly further comprises a plurality of cables extending into the housing and respectively electrically connected with a plurality of printed circuit boards.

4. The electrical connector assembly as recited in claim 1, wherein the housing defines an upper shield part and a lower shield part assembled with each other along a vertical direction.

5. The electrical connector assembly as recited in claim 1, wherein the latch mechanism comprises a latching member and a pulling member interconnected with each other.

6. The electrical connector assembly as recited in claim 5, wherein the pulling member has an operating section, a pair of actuating sections connected to the latching member and a connecting section connecting the pair of actuating sections to the operating section.

7. An electrical connector assembly, comprising:

a metallic housing defining a first shield part and a second shield part assembled with each other;

a plurality of conductive contacts disposed in the housing;

at least one cable extended into the housing and electrically connected with the conductive contacts;

a strain relief disposed in the housing and sandwiched by the first shield part and the second shield part; and engaging means assembled to the housing and interconnected with the upper shield part, the lower shield part and the strain relief; wherein the electrical connector assembly further comprises a latch mechanism assembled to an exterior surface of the housing and a metallic shield assembled to the housing and shielding a portion of the latch mechanism; wherein the latch mechanism comprises a pair of latching members and a pulling member interconnected to the pair of latching members; wherein the pulling member has an operating section, two actuating sections respectively connected to the pair of latching members and two connecting sections respectively connecting each actuating section to the operating section; wherein the pulling member has an operating section, a pair of actuating sections connected to the latching member and a connecting section connecting the pair of actuating sections to the operating section.

8. An electrical connector comprising:

a housing defining a plurality of mating ports side by side arranged with one another in a transverse direction;

a plurality of electronic components disposed in the housing and communicating with the corresponding mating ports;

a plurality of cables linked to rear sides of the electronic components, respectively;

a latch mechanism actuated by a pulling member and defining a locking section;

a metallic holder protectively shielding the latch mechanism;

a strain relief structure formed around a rear end of the housing and holding the corresponding cables to share forces applied upon the cables; and an engaging device assembling the strain relief structure and the metallic holder together; wherein the strain relief is discrete from the housing; wherein the housing defines two halves, and the strain relief is sandwiched between said two halves under condition that the engaging devices extends through the two halves and the strain relief in a vertical direction; wherein the cables are sandwiched between the two halves and the strain relief in the vertical direction; wherein the whole locking section is sized smaller than a total transverse dimension of said plurality of mating ports.

* * * * *